US008656811B2

(12) United States Patent
Ho

(10) Patent No.: US 8,656,811 B2
(45) Date of Patent: Feb. 25, 2014

(54) FOLDING HAND TOOL

(76) Inventor: Shih-Chi Ho, Taichung (TW)

( * ) Notice: Subject to any disclaimer, the term of this patent is extended or adjusted under 35 U.S.C. 154(b) by 294 days.

(21) Appl. No.: 13/166,268

(22) Filed: Jun. 22, 2011

(65) Prior Publication Data

US 2012/0325057 A1 Dec. 27, 2012

(51) Int. Cl.
*B25B 23/16* (2006.01)

(52) U.S. Cl.
USPC ..... 81/177.8; 81/177.7; 81/177.6; 81/177.5

(58) Field of Classification Search
USPC ..... 81/177.8, 177.9, 177.5, 177.6, 177.7, 81/177.4, 60
See application file for complete search history.

(56) References Cited

U.S. PATENT DOCUMENTS

| | | | | |
|---|---|---|---|---|
| 7,287,450 | B1 * | 10/2007 | Liao | 81/177.9 |
| 7,698,972 | B2 * | 4/2010 | Hi | 81/177.8 |
| 7,866,235 | B2 * | 1/2011 | Hi | 81/177.8 |
| 8,342,062 | B2 * | 1/2013 | Chen et al. | 81/177.9 |

* cited by examiner

*Primary Examiner* — Hadi Shakeri
(74) *Attorney, Agent, or Firm* — Egbert Law Offices, PLLC

(57) ABSTRACT

A foldable hand tool has a handle and a driving head. The handle has a driving head guide groove which extends along the handle and penetrates one side of the handle. A combined lug protrudes from an assembly end of the driving head and is fitted slidably with the driving head guide groove. The driving head is slidable along the driving head guide groove such that the driving head swings perpendicular to the handle. The hand tool can be positioned in a straight configuration or in a T-shaped pattern.

5 Claims, 7 Drawing Sheets

FOLDING HAND TOOL

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a ratchet type tool, and more particularly to an innovative one which can be folded for further use.

2. Description of Related Art Including Information Disclosed Under 37 CFR 1.97 and 37 CFR 1.98.

Given the fact that the conventional hand tool for locking or unlocking of screws and nuts must be firstly disengaged and then reversely set or rotated, this requires development of novel ratchet type tools, such as ratchet spanners, ratchet screwdrivers and ratchet sockets, so as to address such kinds of problems.

Notwithstanding a variety of ratchet type tools with different structures in the relevant industry, the present invention intends to improve said ratchet screwdriver. In fact, a foldable ratchet screwdriver has been developed for some special operating environments. However, the head of an existing ratchet screwdriver can only swing at the active end of the handle, leading to insufficient structural or functional flexibility.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The enhanced efficacy of the present invention is as follows:

According to the unique construction of the present invention, the "foldable hand tool" is mainly characterized by that, the handle is provided with a driving head guide groove, and the tool's driving head is provided with a combined lug, so the tool's driving head can be extended to the handle's active end in a straight pattern, or folded into an L-shaped pattern. Or with the fitting of the driving head guide groove and combined lug, the tool's driving head could slide along the driving head guide groove and is then locked onto the handle body in a T-shaped pattern, thus improving the ease-of-operation and flexibility to meet the customer demands with higher applicability.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
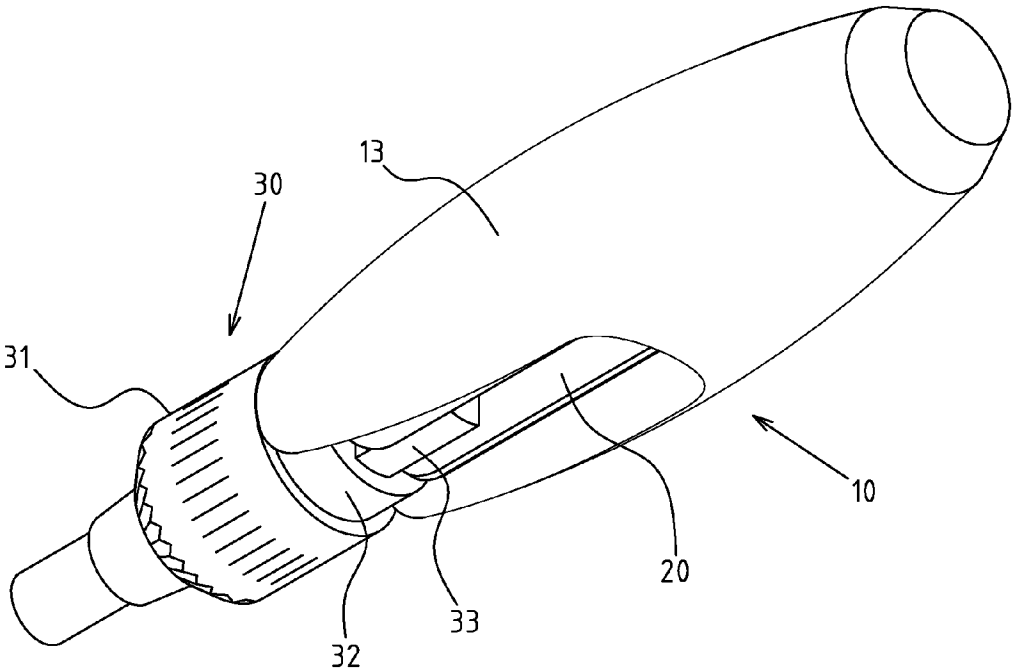
FIG. 1 is an upper perspective view of the hand tool of the present invention.
Figure 2A:
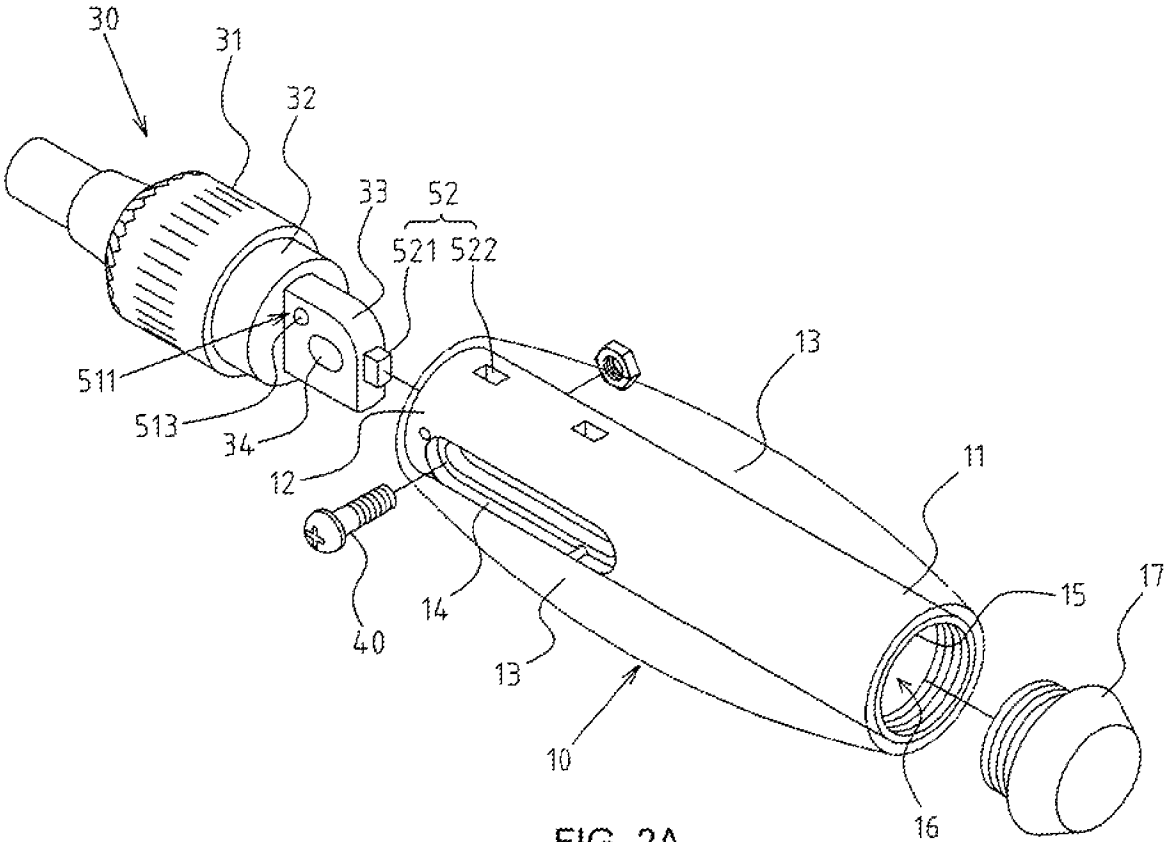
FIG. 2A is an exploded perspective view of a preferred embodiment of the present invention.
Figure 2B:
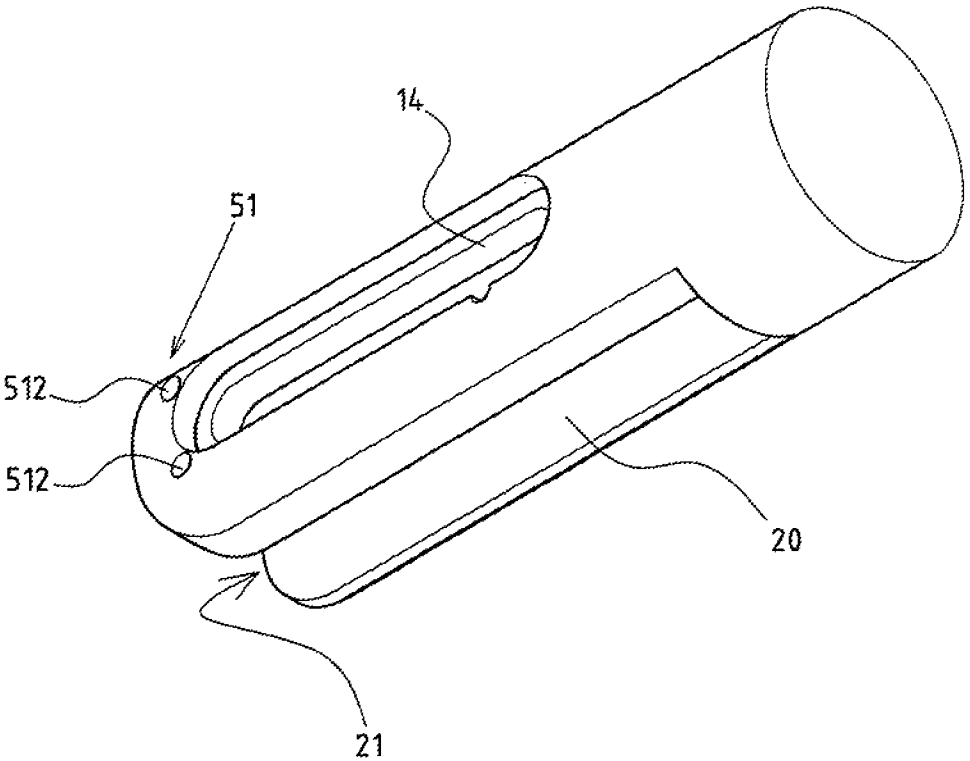
FIG. 2B is an isolated perspective view of the driving head guide of the preferred embodiment of the present invention.

FIGS. 1, 2A and 2B depict preferred embodiments of a foldable hand tool of the present invention, which, however, are provided for only explanatory objective for patent claims. Said hand tool is a ratchet screwdriver, comprising a handle 10 in an elongated pattern, comprising of a holding end 11, an active end 12 and two side walls 13. A long guide hole 14 set on the handle body penetrates two side walls 13 of the handle 10.

A driving head guide groove 20 is extended perforatively along the handle 10 to the end of the handle body for forming an end opening 21. A long guide hole 14 set on two side walls 13 of the handle 10 penetrates vertically the driving head guide groove 20.

A tool's driving head 30 is combined rotatably with said handle 10, such that it can be extended to the active end 12 of the handle 10 or run perpendicular to the handle 10 via swinging. Of which the tool's driving head 30 has an active head 31 and an assembly end 32.

A combined lug 33 is protruded from the assembly end 32 of the tool's driving head 30, and is fitted slidably with the driving head guide groove 20 of the handle 10. When the tool's driving head 30 swings perpendicular to the handle 10, it can slide along the driving head guide groove 20.

A locking member 52 has a locking lug 521 protruded from the combined lug 33 and some dents 522 arranged at interval on the handle body. When the tool's driving head 30 runs perpendicular to the handle 10, it can be locked securely through interlocking of the locking lug 521 and dents 522.

A long through-hole 34 is set on the combined lug 33 of the tool's driving head 30, and extended along the tool's driving head 30. Moreover, the tool's driving head 30 can shift forwards or backwards via the extension of the long through-hole 34, such that the locking lug 521 and dents 522 are combined or disengaged. Of which, the tool's driving head 30 permits a locator 40 to penetrate the long guide hole 14 and long through-hole 34 of the handle 10 for assembly positioning, such that the tool's driving head 30 can swing by taking said locator 40 as a pivot.

A locating element 50 is set oppositely to the handle 10 and tool's driving head 30, allowing to locate stably the tool's driving head 30.

With the arrangement of said driving head guide groove 20, the hand tool can be designed into a straight or T-shaped or L-shaped pattern.

Referring to FIGS. 2A and 2B, a bead set 511 of the locating element 50 is set on the combined lug 33 of said tool's driving head 30, and a plurality of locating slots 512 is set on the active end 12 and handle body of the handle 10. Moreover, the bead set 511 is provided with an elastic element and a bead 513. Said bead 513 is protruded elastically and locked into any locating slot 512 of the handle 10.

Figure 3:
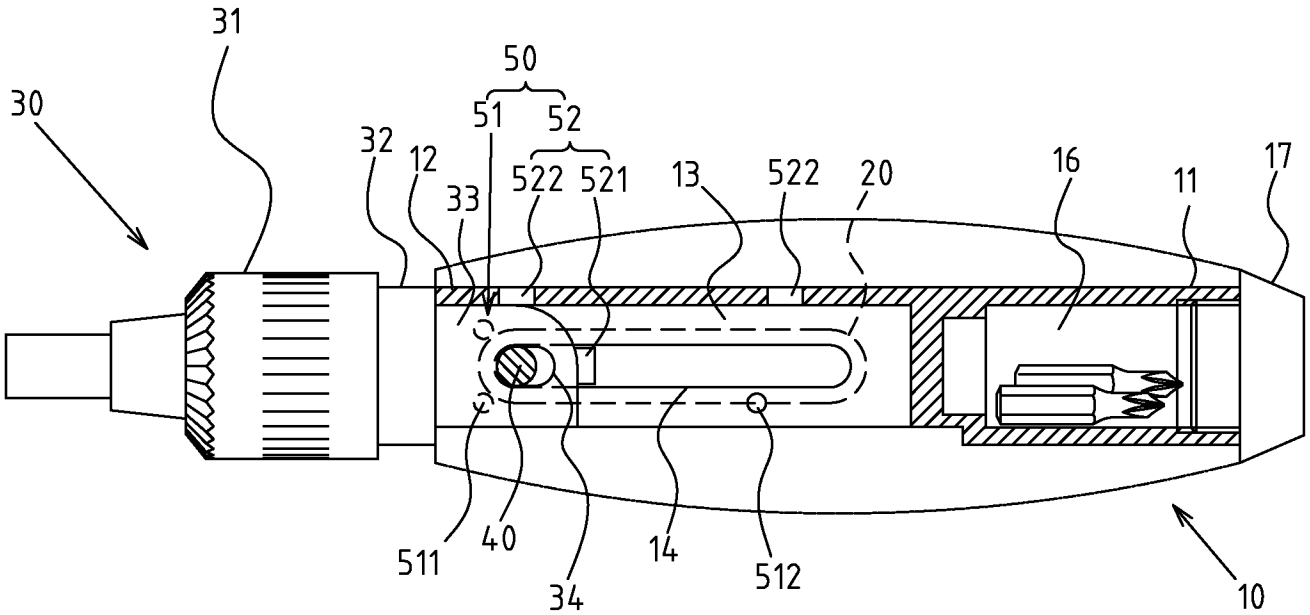
FIG. 3 is an assembled sectional view of a preferred embodiment of the present invention.

Of which, a holding space 16 with opening 15 is set on the holding end 11 of the handle 10, and opened or closed via a lid 17. Said holding space 16 is used to accommodate different tool heads for the users (in collaboration with FIGS. 2A, 2B and 3).

Figure 4:
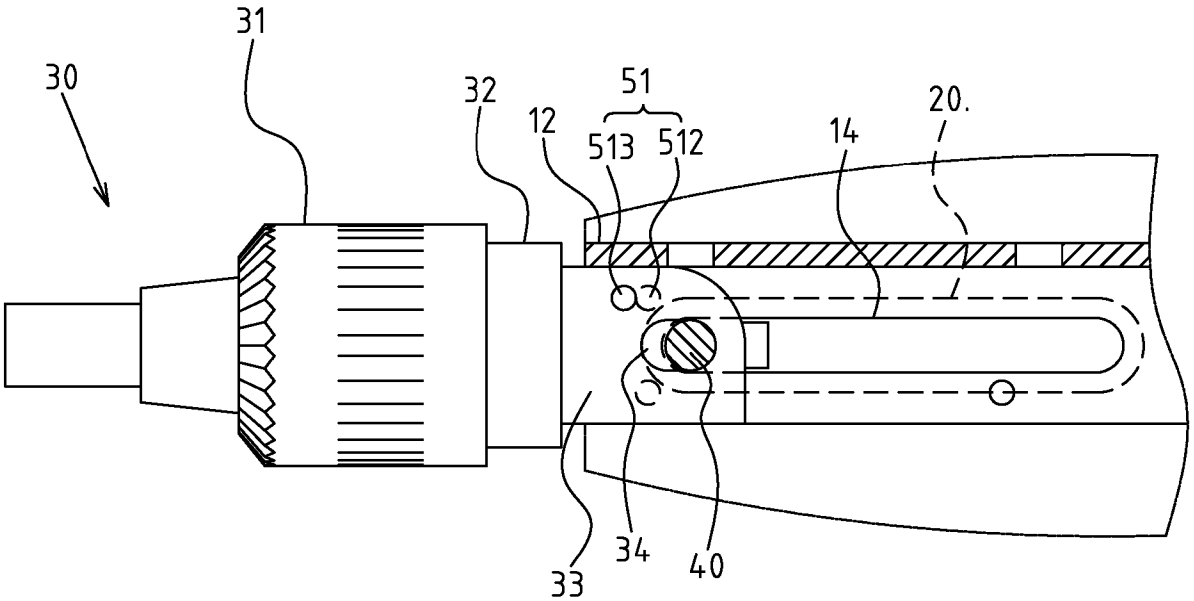
FIG. 4 is a schematic view of the present invention wherein the hand tool is used in a straight pattern.
Figure 5A:
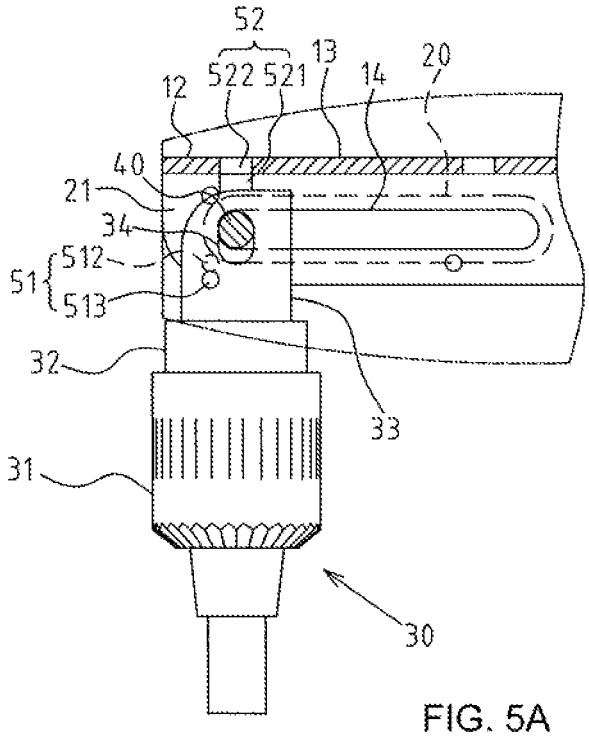
FIGS. 5*a* and 5B are schematic views of the present invention wherein the hand tool is used in an L-shaped pattern.
Figure 5B:
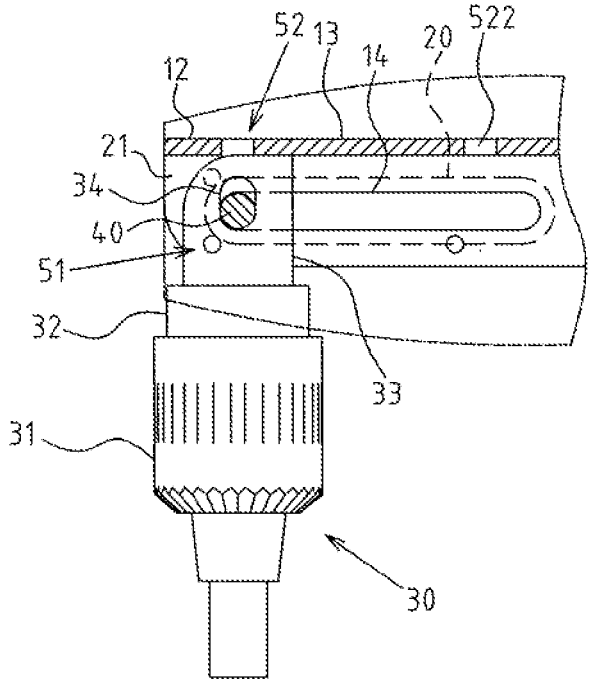
Figure 6A:
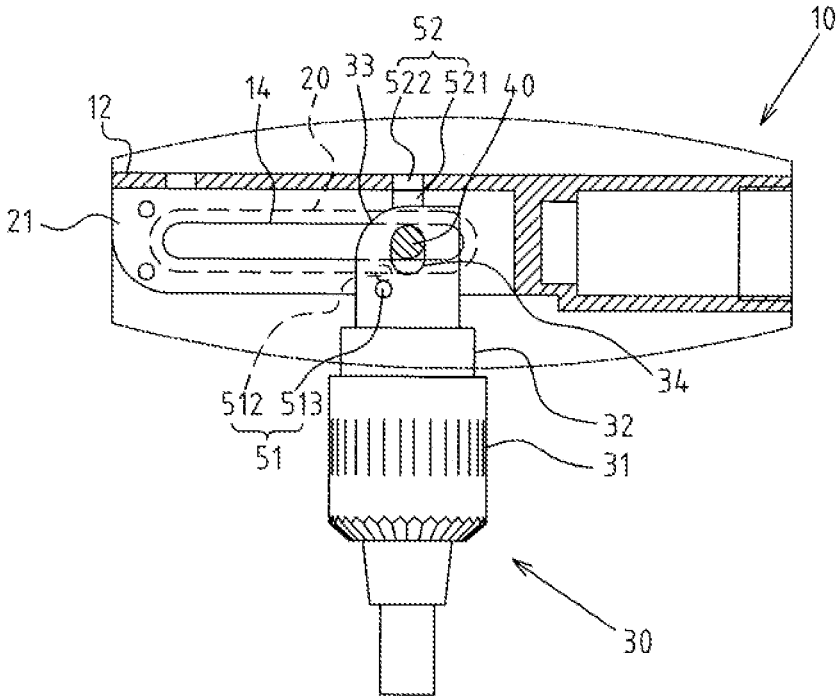
FIGS. 6A and 6B are schematic views of the present invention wherein the hand tool is used in a T-shaped pattern.
Figure 6B:
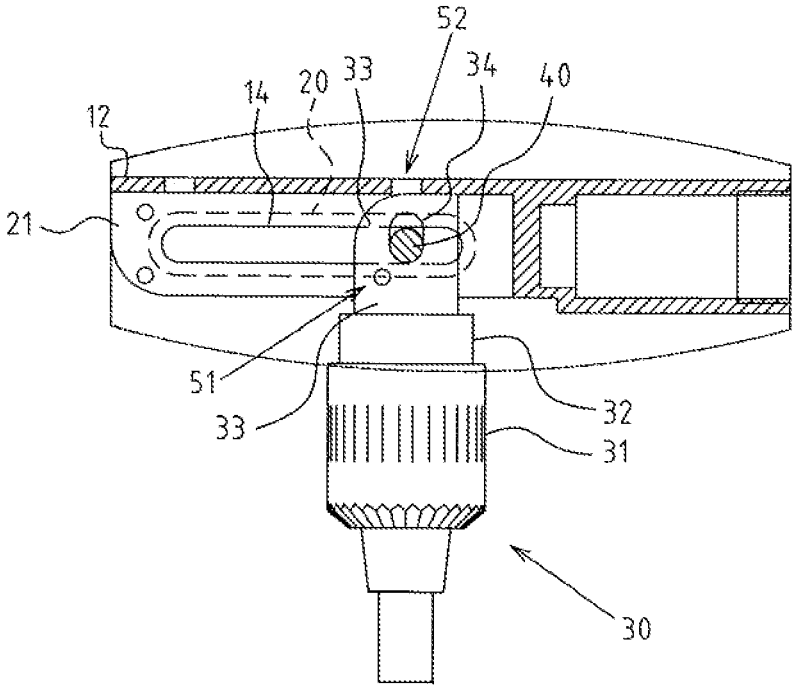

Based on above-specified structural configuration, the core element of the hand tool of the present invention lies in that, the handle 10 is provided with a driving head guide groove 20, and the tool's driving head 30 is provided with a combined lug 33, the tool's driving head 30 can be designed into a straight or T-shaped pattern. In this preferred embodiment, the hand tool is used in such a manner that the long through-hole 34 of the tool's driving head 30 is fitted with the locator 40 and locating element 50. When the tool's driving head 30 isn't rotated, it is extended to the active end 12 of the handle 10, and locked into the first locating slot 512 of the handle 10 via the bead set 511, so that the hand tool is used in a straight pattern (disclosed in FIGS. 3, 4). When the tool's driving head 30 is rotated, it is forcibly pulled outwards with the arrangement of the long through-hole 34 and elastic setting of the bead set 511, so that the tool's driving head 30 could swing flexibly to one side of the active end 12 of the handle 10, and the locking lug 521 is locked into the first dent 522. The bead set 511 is locked into the second locating slot 512 of the handle 10, so that the tool's driving head 30 can be locked securely. With this configuration, the hand tool is used in an L-shaped pattern (shown in FIGS. 5A and 5B). Next, referring also to FIGS. 6A and 6B, when the tool's driving head 30 is pulled by the force applied by the user, and the locking lug 521 is disengaged from the first dent 522, the tool's driving head 30 slide along the driving head guide groove 20. When the locking lug 521 is located correspondingly to the second dent 522, the tool's driving head 30 can be locked securely since the locking lug 521 and the second dent 522 are interlocked, and the bead set 511 is locked into the third locating slot 512 of the handle 10. In such case, the assembly state of said tool's driving head 30 is stable and reliable, and such hand tool is used in a T-shaped pattern.

I claim:

1. A foldable hand tool comprising:

a handle having an elongate shape, said handle having a holding end and an active end and a pair of side walls;

a driving head guide groove formed along said handle toward an end of said handle so as to form an end opening, said handle having an elongate guide hole formed on said pair of side walls so as to vertically penetrate said driving head guide groove;

a driving head rotatably mounted on said handle, said driving head extendable to said active end of said handle or swingable so as to extend perpendicular to said handle, said driving head having an active head and an assembly end;

a combined lug protruding from said assembly end of said driving head, said combined lug slidably mounted in said driving head guide groove such that said driving head can slide along said driving head guide groove when said driving head swings perpendicular to said handle;

a locking member having a locking lug protruding from said combined lug and dents arranged in spaced relation on said handle, said locking lug engaged with the dent so as to securely lock said driving head perpendicular to said handle;

an elongated through-hole positioned on said lug and extending along said driving head, said driving head shiftable forwards or backwards along said elongated through-hole such that said locking lug and said dents are engaged or disengaged; and a locating element positioned on said handle opposite said driving head, said driving head guide groove allowing the hand tool to have a straight shape or a T-shape.

2. The foldable hand tool of claim 1 in which the foldable hand tool is a ratchet screwdriver.

3. The foldable hand tool of claim 1, said locating element having a bead set positioned on said combined lug, said active end of said handle having a plurality of locating slots, said bead set having an elastic element and a bead, said bead protruding elastically and locked into one of said plurality of locating slots.

4. The foldable hand tool of claim 1, said handle having a holding end, said holding end having a holding space with an opening, said holding end having a lid for opening or closing said holding space.

5. The foldable hand tool of claim 1, said hand tool foldable into an L-shaped pattern.

* * * * *